US005441407A

United States Patent [19]

Stamm et al.

[11] Patent Number: 5,441,407

[45] Date of Patent: Aug. 15, 1995

[54] ROLLER FOR ROLLER-HEARTH FURNACES

[75] Inventors: Dietrich Stamm, Essen; Alwin Vogel, Eisenberg; Hermann Stein, Dürkheim, all of Germany

[73] Assignee: LOI Essen Industrieofenanlagen GmbH, Essen, Germany

[21] Appl. No.: 344,518

[22] Filed: Nov. 23, 1994

Related U.S. Application Data

[63] Continuation of Ser. No. 989,031, Dec. 10, 1992, abandoned.

[30] Foreign Application Priority Data

Dec. 14, 1991 [DE] Germany ..... 41 41 250.8

[51] Int. Cl.[6] ..... F27D 3/00

[52] U.S. Cl. ..... 432/246; 432/234

[58] Field of Search ..... 432/246, 236, 230; 138/133, 125; 428/34.4; 60/253

[56] References Cited

U.S. PATENT DOCUMENTS

| | | | |
|---|---|---|---|
| 2,695,248 | 11/1954 | Ornitz et al. | 432/246 |
| 2,950,097 | 8/1960 | Tohr | 432/246 |
| 3,051,460 | 8/1962 | Furczyk | 432/236 |
| 3,456,931 | 7/1969 | Ermenc et al. | 432/246 |
| 3,766,949 | 10/1973 | Champleboux et al. | 138/133 |
| 3,830,625 | 8/1974 | Cable et al. | 432/236 |
| 3,853,526 | 12/1974 | Hochart | 432/246 |
| 4,049,371 | 9/1977 | Prible | 432/236 |
| 4,140,486 | 2/1979 | Nitschke | 432/246 |
| 4,167,953 | 9/1979 | Carlstrom | 138/133 |
| 4,776,071 | 10/1988 | Yoshizawa | 432/246 |
| 4,830,625 | 8/1974 | Cable et al. | 432/236 |
| 5,062,456 | 11/1991 | Cooke et al. | 138/133 |
| 5,070,587 | 12/1991 | Nakahira et al. | 432/246 |
| 5,182,147 | 1/1993 | Davis | 138/133 |
| 5,230,618 | 7/1993 | Bricmont et al. | 432/246 |

*Primary Examiner*—Raymond A. Nelli

*Attorney, Agent, or Firm*—Blakely, Sokoloff, Taylor & Zafman

[57] ABSTRACT

The roller exhibits a support body which is provided with a plurality of support disks. Insulating layers are arranged between the support disks. A heat-resistant cable surrounding the support body in several coils is embedded in each insulating layer. The insulating layer consists of fiber material which is sprayed on at the same time as the cable is wound around the support body. The cable provides a firm and lasting connection of the insulating layer to the support body.

9 Claims, 1 Drawing Sheet

ROLLER FOR ROLLER-HEARTH FURNACES

This is a continuation of application Ser. No. 07/989,031 filed Dec. 10, 1992, abandoned.

BACKGROUND OF THE INVENTION

1. Field of the Invention

The present invention relates in general to the field of roller-hearth furnaces and in particular to a roller for roller-hearth furnaces, said roller exhibiting a rotatable support body, a plurality of support disks mounted on the support body and, adjacent to the support disks, heat-insulated areas in each of which the support body is surrounded by at least one insulating layer of fibre material. Further, the present invention relates to a method for heat-insulating such a roller wherein by spray application of a fibre material at least one insulating layer surrounding an area to be insulated of a support body of the roller is created.

2. Prior Art

Such rollers have proved useful in practice. The heat insulation ensures that, on the one hand, the material to be heat-treated is not inadmissibly cooled and that, on the other hand, the support body of the roller is not inadmissibly heated. The support body can preferably be designed as an interior-cooled pipe.

A major difficulty lies in the fastening and mounting of the insulation consisting of fibre material. For example, from the DE-PS 37 40 620 and the DE-OS 40 41 217 it is known to provide the insulating layer with a jacket protecting and holding the fibre material together. However, with this method there is a danger of scale adhering to this jacket and growing until it has the same circumference as the rollers. This can lead to damage to the material to be treated. One at least equally serious consequence may be that the jacket breaks and the fibre material subsequently detaches itself. The roller must then be replaced immediately as otherwise the support body will overheat and be destroyed.

Further, the German patent application P 40 25 935.8 without prior disclosure describes a roller in which the areas to be insulated of the support body are surrounded by a fibre mat provided with needles onto which a fibre material is sprayed. The fibre material bonds with the fibre mat. Additional hold is provided by anchors which are fastened to the support body, penetrate the fibre mat and engage in the sprayed-on fibre material with flat clamping means. It has been found that this type of insulation does not stand up to the vibration loads occurring during operation. The fibre material increasingly detaches itself around the anchors, begins to crumble and finally falls off. Immediate maintenance work is also necessary in this case to avoid destruction of the support body.

SUMMARY OF THE INVENTION

It is an object of the present invention to increase the life of the roller in a simple manner and thus to reduce the need for maintenance with the objective of minimizing the frequency of roller replacement during maintenance work and the costs associated therewith.

According to the present invention, this object is achieved by the roller characterised in that at least one heat-resistant cable wound around the support body in several coils is embedded in the layer of fibre material.

The fibre material bonds with the heat-resistant cable, creating a relatively large contact surface. The cable itself is firmly connected to the support body since it is wound several times around said support body. Shocks and vibrations acting on the support disks during operation and transferred by said support disks to the support body cannot separate the fibre material from the heat-resistant cable or cause the fibre material to crumble and detach itself from the roller. It has been found that the life of the roller is at least equivalent to the maintenance intervals for the roller-hearth furnace.

The secure mounting of the cable on the support body of the roller is promoted by the fact that the cable shrinks as it dries, thus creating circumferential tensions in the insulating layer. The fibre material alone is not capable thereof due to the random orientation of the fibres. The cable can rest directly on the support body of the roller or on an intermediate layer covering the support body, thus optimizing tension between the cable and the support body. It is also possible to embed the cable in the fibre material in such a manner that it is completely surrounded by the fibre material. This leads to an extremely secure bond between the cable and the fibre material. This effect can be promoted by the cable having as coarse a structure as possible, for example the form of a plait or the like.

The cable preferably forms coil sections wound in opposing directions, said coil sections being adjacent to each other in the axial direction of the support body.

Further, it is advantageous for the cable to occupy practically the entire thickness of the insulating layer in order to guarantee optimum hold, the cable preferably forming at least two layers arranged one on top of the other. The bottom layer serves mainly to ensure a firm connection between the cable and the roller support body with which said bottom layer may be in contact, whilst the top layer makes the entire circumference of the cable available for connection to the fibre material. Circumferential tension occurs in both layers. Each layer may consist of coil sections wound in opposing directions. In any case, it is particularly advantageous if the layers are wound in opposing directions.

In a further embodiment of the present invention, it is proposed that the cable is fixed to the support body at one point at least, thus additionally strengthening the connection between the insulation and the support body of the roller. It is particularly advantageous if the cable fixing point is at a distance to the two ends of the cable. The two cable strands may be wound, so to speak, like a double-threaded screw. They may also form coil sections wound in opposing directions, both starting from the cable fixing point, provided that the cable fixing point is at a distance to the two ends of the heat-insulated area, as proposed as a further embodiment of the invention. A clamping band preferably serves to fix the cable to the support body.

It has proved particularly advantageous for the cable to consist primarily of insulating fibres. In a further embodiment of the present invention, it may contain at least one heat-resistant wire promoting cable strength.

According to the present invention the method to achieve the desired object is characterised in that in the area to be insulated at least one heat-resistant cable is wound around the support body of the roller in several coils and is embedded in the insulating layer.

It is possible to first wind the cable on the support body or to wind the cable on an intermediate layer surrounding said support body and then to spray on the fibre material. The cable may, however, also be wound into the fibre layer. Further, it is possible to combine these two steps with each other, i.e. to wind a first layer of cable around the support body, then to spray on the fibre material and finally to wind one or several layers of cable into the fibre material layer before it hardens.

It has proved particularly advantageous for the cable to be wound at the same time as the fibre material is sprayed on. It has been found that a particularly long-lasting bond occurs when this procedure is adopted.

The procedure is particularly simple if the support body is rotated while the cable is being wound and the fibre material sprayed on. For this purpose, all that is required is a turning device and the deployment of two workers, one to hold the cable strand or cable strands and the other to guide the spray gun. It is apparent that the method according to the present invention is suitable not only for the manufacture of new rollers but also for the repair or replacement of insulations, where the necessary work may be carried out on site.

The cable is preferably fixed on the support body of the roller at the start of winding so that work on spraying on the fibre material can be commenced immediately. It is particularly advantageous for the cable to be fixed approximately in its middle and the two strands of the cable to be wound simultaneously in opposing directions. Thus, from the middle of the area to be insulated, layer of cable upon layer of cable is formed, the coils running in opposing directions, each layer consisting of two coil sections running in opposite directions. It has been found that with this procedure optimum process control and optimum life of the end product are achieved.

Such combinations of the inventive features which deviate from the combinations discussed hereinabove are deemed to be disclosed as essential to the invention.

The objects and features of the present invention will now be described in more detail below with reference to preferred embodiments as shown by the attached figures.

DETAILED DESCRIPTION OF THE INVENTION

Figure 1:
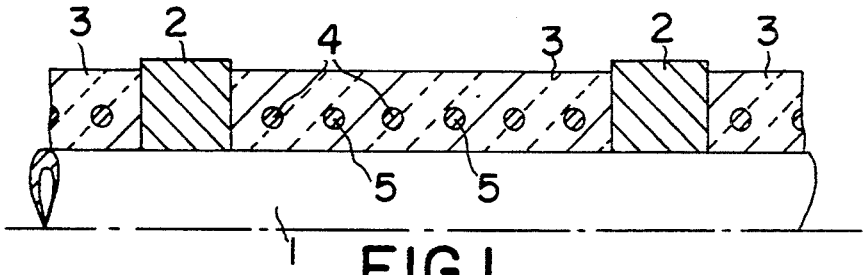
FIG. 1 shows an axial section through part of a roller according to the present invention.

Referring to FIG. 1, the roller exhibits a support body 1 which has the form of a cylindrical pipe and may be interior cooled. The support body 1 is provided with support disks 2 on which the material to be heat-treated rests during transport. The support disks 2 are connected, preferably non-rotatably, to the support body 1, for example by means of mountings. Between the support disks, there are insulating layers 3 made of fibre material which serve to protect the material to be heat-treated from localized cooling and the support body 1 from excessive heating.

A heat resistant cable 4 is embedded in each insulating layer 3. The cable 4 is wound around the support body 1 in several coils and ensures that the insulating layer 3 remains firmly connected to the support body 1 even under very arduous conditions. The cable 4 shrinks under the influence of heat and produces circumferential tensions which press the insulating layer 3 against said support body 1. The connection between the cable 4 and the insulating layer consisting of fibre material is tight and the contact surfaces are large.

The cable 4 itself also consists of insulating fibres and contains a wire 5 to increase its strength.

Figure 2:
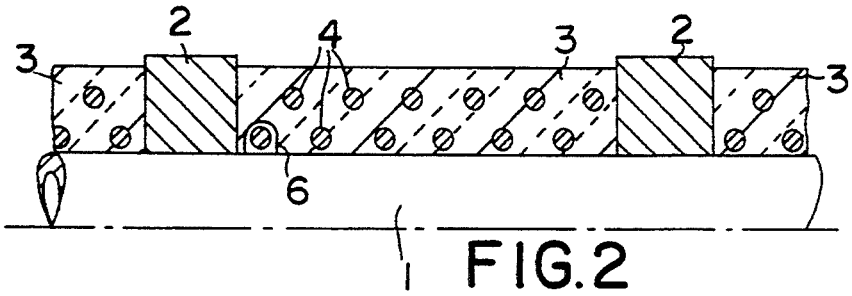
FIG. 2 shows a modified embodiment of that represented in FIG. 1.

Referring to FIG. 2, the heat-resistant cable forms two layers, the bottom layer being in contact with the support body 1 and thus creating a very strong connection with the support body 1. In the top layer, the cable is surrounded completely by fibre material, so that the fibre material can adhere strongly to the cable.

The layers according to FIG. 2 are wound in opposing directions and are formed by a continuous strand of cable, the cable being fixed to the support body 1 as indicated by a clamping means 6.

Figure 3:
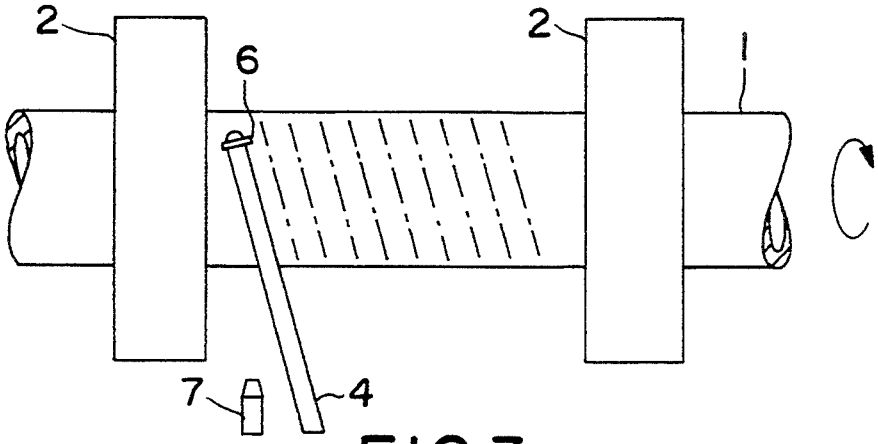
FIG. 3 shows a horizontal projection of part of a roller according to the present invention during application of the heat insulation.

FIG. 3 shows the start of the manufacturing process. One end of the cable 4 is already fixed to the support body 1 of the roller by means of the clamping means 6. The support body 1 is mounted so as to permit its rotation and is then rotated as indicated by an arrow. At the same time, a spray gun 7 represented schematically is put into operation spraying the fibre material onto the support body 1 while the coils of the cable are formed in the direction indicated by the dot-dash line. The spray gun 7 is moved in axial direction. In this manner, a first layer of cable coils is formed. The next layer is wound in the opposite direction.

Figure 4:
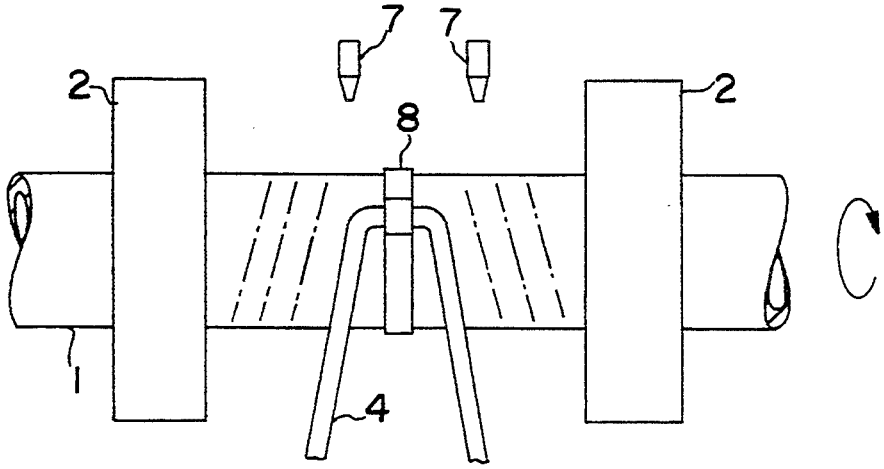
FIG. 4 shows a modified embodiment of that represented in FIG. 3.

In contrast to FIG. 3, the middle of the cable according to FIG. 4 is fixed to the support body 1. The cable fixing point is also roughly in the middle of the area to be insulated between the two adjacent support disks 2. A clamping band 8 is used for fixing. When the support body 1 is rotated and the fibre material is simultaneously sprayed on, an insulating layer forms in which the heat-resistant cable 4 forms coil sections running in opposing directions to the right and left of the clamping band, as indicated by the dot-dash lines. At the end of each layer, the direction of coiling is reversed, the two strands of cable 4 crossing at the level of the clamping band 8. Thus, the individual layers are wound in opposing directions relative to each other here as well.

The process control according to FIG. 4 permits particularly simple, rapid and effective application and securing of the insulation layer consisting of fibre material with embedded cable coils. The method is also suitable for repair work on site.

The present invention permits modifications. Thus, the support body 1 need not be cylindrical in design provided that the circumference of the insulating layer 3 does not exceed the circumference of the support disks 2. The insulating layer need not be sprayed directly onto the support body. An intermediate layer may be applied. The cable 4 may consist of individual sections, but each section must surround the support body 1 in several coils. The surface of the cable should have a coarse structure permitting good adhesion of the fibre material. Plait-shaped cables are particularly suitable.

The fibre material may be sprayed on after the cable coils have been wound, at least after the first layer of cable coils has been wound. The cable coils or at least the top layers of cable coils may be wound into the sprayed-on fibre material. The fibre material can be sprayed on in a moistened state provided it hardens when drying. It may also contain preferably a curing binder. Finally, the cable may be fixed to the support body at a plurality of points to further improve adhesion and facilitate winding.

We claim:

1. A roller for roller-hearth furnaces, said roller exhibiting a rotatable support body, a plurality of support disks mounted on the support body and adjacent to the support disks heat-insulated areas in each of which the support body is surrounded by at least one insulating layer made of fibre material, wherein at least one heat-resistant cable is embedded in the insulating layer of fibre material, further wherein said cable is fixed at least at one point to the support body, said cable being wound around the support body in several coils, wherein the cable forms at least two layers, the one arranged on top of the other.

2. The roller according to claim 1, wherein the support body defines an axial direction and the cable forms coil sections wound in opposing directions, said coil sections being adjacent to each other in the axial direction of the support body.

3. The roller according to claim 1, wherein the cable occupies practically the entire thickness of the insulating layer.

4. The roller according to claim 3, wherein the layers are wound in opposing directions.

5. The roller according to claim 1, wherein the cable has two cable ends and the fixing point of the cable is at a distance to the two ends of the cable.

6. The roller according to claim 5, wherein each heat-insulating area exhibits two ends and the fixing point of the cable is at a distance to the two ends of the relevant heat-insulating area.

7. The roller according to claim 1, wherein the cable is fixed to the support body by means of a clamping band.

8. The roller according to claim 1, wherein the cable consists mainly of insulating fibres.

9. The roller according to claim 8, wherein the cable contains at least one heat-resistant wire.

* * * * *